US010487855B2

(12) United States Patent
Cadman

(10) Patent No.: US 10,487,855 B2
(45) Date of Patent: Nov. 26, 2019

(54) ELECTRO-HYDRAULIC SYSTEM WITH NEGATIVE FLOW CONTROL

(71) Applicant: Deere & Company, Moline, IL (US)

(72) Inventor: Kristen D. Cadman, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 68 days.

(21) Appl. No.: 15/611,446

(22) Filed: Jun. 1, 2017

(65) Prior Publication Data

US 2018/0087540 A1 Mar. 29, 2018

Related U.S. Application Data

(60) Provisional application No. 62/401,507, filed on Sep. 29, 2016.

(51) Int. Cl.
*F15B 11/10* (2006.01)
*E02F 9/20* (2006.01)
(Continued)

(52) U.S. Cl.
CPC ..... *F15B 11/10* (2013.01); *E02F 9/2004* (2013.01); *E02F 9/2235* (2013.01);
(Continued)

(58) Field of Classification Search
CPC ..... E02F 9/2282; E02F 9/2235; F15B 11/165; F15B 13/024; F15B 2211/45
See application file for complete search history.

(56) References Cited

U.S. PATENT DOCUMENTS 5,295,795 A * 3/1994 Yasuda ..... E02F 9/2235 417/213
5,873,245 A 2/1999 Kato et al.
(Continued)

FOREIGN PATENT DOCUMENTS

CN 1670317 A 9/2005
WO WO-2016017674 A1 * 2/2016 ..... E02F 9/20

OTHER PUBLICATIONS

Chinese Patent Office Action for Application No. 201710804392.0 dated Mar. 5, 2019 (16 pages, English translation included).

*Primary Examiner* — Michael Leslie
*Assistant Examiner* — Daniel S Collins
(74) *Attorney, Agent, or Firm* — Michael Best & Friedrich LLP

(57) ABSTRACT

A fluid power system includes an electro-hydraulic variable displacement fluid pump driving fluid at a first displacement value. The system further includes a directional control valve, a sensor, and a controller. The directional control valve includes a valve member movable between a neutral position and at least one actuated position. The directional control valve diverts at least some fluid to an actuator while the valve member is in an actuated position, and the directional control valve exhausts fluid at an exhaust pressure through an outlet port to the fluid reservoir while the valve member is in the neutral position. The sensor measures a difference between the exhaust pressure and a nominal pressure and generates a signal based on the measured difference. The controller generates a flow command at least partially based on the pressure signal to modify the operation of the pump to drive fluid at a second displacement value.

16 Claims, 4 Drawing Sheets

(51) Int. Cl.

| | |
|---|---|
| ***F15B 11/16*** | (2006.01) |
| ***E02F 9/22*** | (2006.01) |
| ***F15B 1/26*** | (2006.01) |
| ***F15B 13/02*** | (2006.01) |
| *E02F 3/32* | (2006.01) |

(52) U.S. Cl.

CPC ..... *E02F 9/2267* (2013.01); *E02F 9/2296* (2013.01); *F15B 1/26* (2013.01); *F15B 11/165* (2013.01); *F15B 13/024* (2013.01); *E02F 3/32* (2013.01); *F15B 2211/20523* (2013.01); *F15B 2211/20546* (2013.01); *F15B 2211/3116* (2013.01); *F15B 2211/35* (2013.01); *F15B 2211/45* (2013.01); *F15B 2211/55* (2013.01); *F15B 2211/56* (2013.01); *F15B 2211/633* (2013.01); *F15B 2211/6306* (2013.01); *F15B 2211/6346* (2013.01); *F15B 2211/6652* (2013.01); *F15B 2211/7051* (2013.01)

(56) References Cited

U.S. PATENT DOCUMENTS

| | | | | |
|---|---|---|---|---|
| 9,103,095 | B2 | 8/2015 | Nishikawa et al. | |
| 9,586,473 | B2 | 3/2017 | Pfohl et al. | |
| 2005/0204912 | A1 | 9/2005 | Toji et al. | |
| 2009/0308068 | A1 | 12/2009 | Yoshino | |
| 2013/0061587 | A1 | 3/2013 | Jagoda | |
| 2013/0312403 | A1* | 11/2013 | Lim ..... | E01F 9/2235 60/462 |
| 2013/0333367 | A1 | 12/2013 | Jeon et al. | |
| 2014/0166114 | A1 | 6/2014 | Wang et al. | |
| 2015/0176252 | A1 | 6/2015 | Kim et al. | |
| 2017/0130428 | A1* | 5/2017 | Matsuzaki ..... | E02F 9/20 |

* cited by examiner

ELECTRO-HYDRAULIC SYSTEM WITH NEGATIVE FLOW CONTROL

CROSS-REFERENCE TO RELATED APPLICATION

This application claims the benefit of prior-filed, U.S. Provisional Patent Application No. 62/401,507, filed Sep. 29, 2016, the entire contents of which are incorporated by reference herein.

BACKGROUND

The present disclosure relates to a hydraulic system for a work machine. More particularly, the disclosure relates to an electro-hydraulic system with negative flow control.

A hydraulic system for a work machine may include one or more pumps driven by an engine and driving fluid to one or more flow control valves. The flow control valve diverts at least a portion of the fluid to one or more actuators to operate the work machine. Fluid is then exhausted from the flow control valve(s) and actuator(s).

SUMMARY

In one aspect, a fluid power system includes an electro-hydraulic variable displacement fluid pump, a directional control valve, a sensor, and a controller. The electro-hydraulic variable displacement fluid pump is configured to receive fluid from a fluid reservoir and drive the fluid at a first displacement value. The directional control valve includes an inlet port and at least one outlet port, and the inlet port is configured to receive the fluid from the pump. The directional control valve further includes a valve member movable between a neutral position and at least one actuated position. The directional control valve is configured to divert at least some fluid to an actuator while the valve member is in the at least one actuated position, and the directional control valve is further configured to exhaust fluid through one of the at least one outlet ports at an exhaust pressure to the fluid reservoir while the valve member is in the neutral position. The sensor measures a difference between the exhaust pressure and a nominal pressure, and the sensor is configured to generate a pressure signal based on the difference between the exhaust pressure and the nominal pressure. The controller is configured to receive the pressure signal from the sensor. The controller is further configured to generate a flow command to modify the operation of the pump to drive fluid at a second displacement value at least partially based on the pressure signal.

In another aspect, a fluid power system includes an electro-hydraulic variable displacement pump, a directional control valve, a sensor, and a controller. The electro-hydraulic variable displacement fluid pump is configured to receive fluid from a fluid reservoir and drive the fluid at a first displacement value. The directional control valve includes an inlet port and at least one outlet port, and the inlet port is configured to receive the fluid from the pump. The directional control valve further includes a valve member movable between a neutral position and at least one actuated position. The directional control valve configured to divert at least some fluid to an actuator while the valve member is in the at least one actuated position, and the directional control valve is further configured to exhaust fluid at an exhaust pressure through one of the at least one outlet ports to the fluid reservoir while the valve member is in the neutral position. The sensor measures a difference between the exhaust pressure and a nominal pressure, and the sensor is configured to generate a pressure signal based on the difference between the exhaust pressure and the nominal pressure. The controller is configured to receive the pressure signal from the sensor, and the controller is configured to generate a flow command to modify the operation of the pump to drive fluid at a second displacement value. The controller is selectively operable in one of at least two modes, and the flow command is at least partially based on the pressure signal in one of the at least two modes.

In yet another aspect, a work machine includes a prime mover, a chassis, and a fluid power system. The chassis includes a traction drive system and a boom. The fluid power system includes a fluid reservoir, an electro-hydraulic variable displacement fluid pump, a directional control valve, a sensor, and a controller. The electro-hydraulic variable displacement fluid pump is driven by the prime mover and is configured to receive fluid from the fluid reservoir. The pump is operable to drive the fluid at a first displacement value. The directional control valve includes an inlet port and at least one outlet port. The inlet port is configured to receive the fluid from the pump. The directional control valve further includes a valve member movable between a first position and a second position. The directional control valve is configured to divert at least some fluid to an actuator while the valve member is in the second position. The directional control valve configured to exhaust fluid through one of the at least one outlet ports at an exhaust pressure to the fluid reservoir while the valve member is in the first position. The sensor measures a difference between the exhaust pressure and a nominal pressure, and the sensor is configured to generate a pressure signal based on the difference between the exhaust pressure and the nominal pressure. The controller is further configured to receive the pressure signal from the sensor. The controller is configured to generate a flow command to modify the operation of the pump to drive fluid at a second displacement value at least partially based on the pressure signal.

In still another aspect, a method for operating a fluid power system of a work machine includes: operating a variable displacement electro-hydraulic fluid pump to supply a fluid at a first displacement value to a directional control valve; electrically sensing a pressure difference between a nominal pressure and an exhaust pressure of fluid exhausted from the directional control valve to a fluid reservoir; generating a flow command based on one of the sensed pressure difference or a predetermined flow requirement associated with an auxiliary attachment supported on the work machine; and in response to the flow command, modifying the operation of the pump to drive the fluid at a second displacement value different from the first displacement value.

Other aspects will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways. Also, it is to be understood that the phraseology and terminology used herein is for the purpose of description and should not be regarded as limiting.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, aspects of the invention may be implemented in software (for example, stored on non-transitory computer-readable medium) executable by one or more processing units, such as a microprocessor, an application specific integrated circuit ("ASIC"), or another electronic device. As such, it should be noted that a plurality of hardware- and software-based devices, as well as a plurality of different structural components may be utilized to implement the invention. For example, "controllers" described in the specification may include one or more electronic processors or processing units, one or more computer-readable medium modules, one or more input/output interfaces, and various connections (for example, a system bus) connecting the components.

Figure 1:
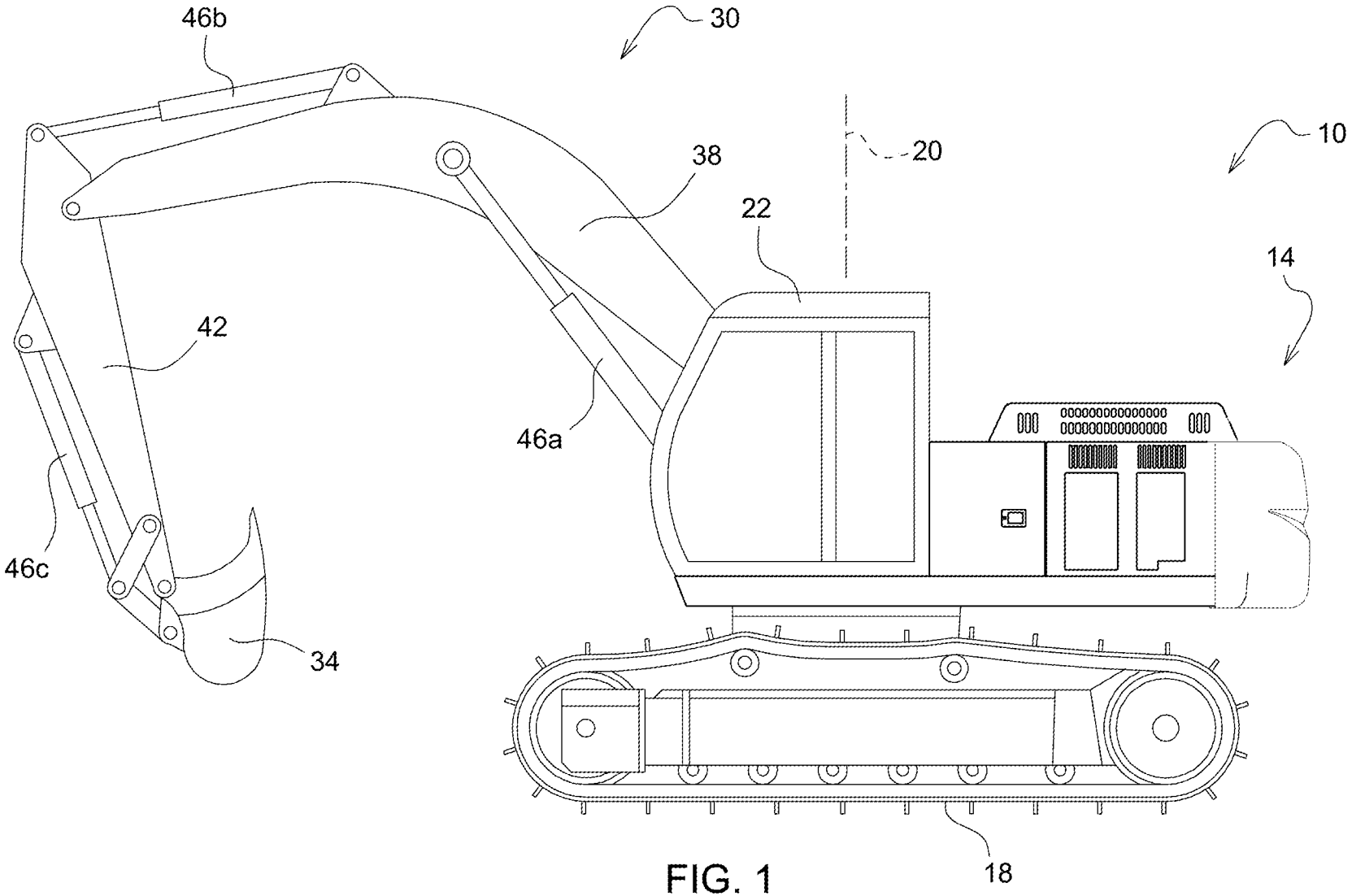
FIG. 1 is a side view of an excavator.

FIG. 1 illustrates a work machine, such as a hydraulic excavator 10, including a chassis or frame 14 and traction members (e.g., crawler tracks 18) for supporting and propelling the frame 14 along a surface. In some embodiments, the frame 14 includes a platform that is rotatable relative to the tracks 18 about a vertical axis 20. The excavator 10 further includes an operator cab 22 and a boom 30 supported on the frame 14. A tool or work attachment (e.g., a bucket 34) may be coupled to an end of the boom 30. The excavator 10 also includes a drive system having a prime mover or engine (not shown), motors (not shown) for driving the tracks 18, and motors (not shown) for pivoting the platform about the axis 20. In some embodiments, the motors are hydraulic motors.

Although the work machine is illustrated and described as an excavator, it is understood that the work machine may have a different form, such as a loader, a dozer, a motor grader, a scraper, or another type of construction, mining, agricultural, or utility machine. Also, although the work attachment is illustrated and described as a bucket, it is understood that the work attachment may have a different form, such as an auger, a breaker, a ripper, a grapple, or some other type of attachment for digging, breaking, handling, carrying, dumping or otherwise engaging dirt or other material. In addition, the work attachment may be detachable from the boom 30 to permit another type of work attachment to be coupled to the boom 30.

In the illustrated embodiment, the boom 30 includes a primary member or hoist portion 38 pivotably coupled to the frame 14 and an arm or stick portion 42 pivotably coupled to an end of the hoist portion 38. The work attachment 34 is pivotably coupled to an end of the stick portion 42. The excavator 10 includes actuators such as hydraulic cylinders 46 for actuating or moving the bucket 34, the hoist portion 38, and the stick portion 42 relative to one another and relative to the frame 14.

Figure 2:
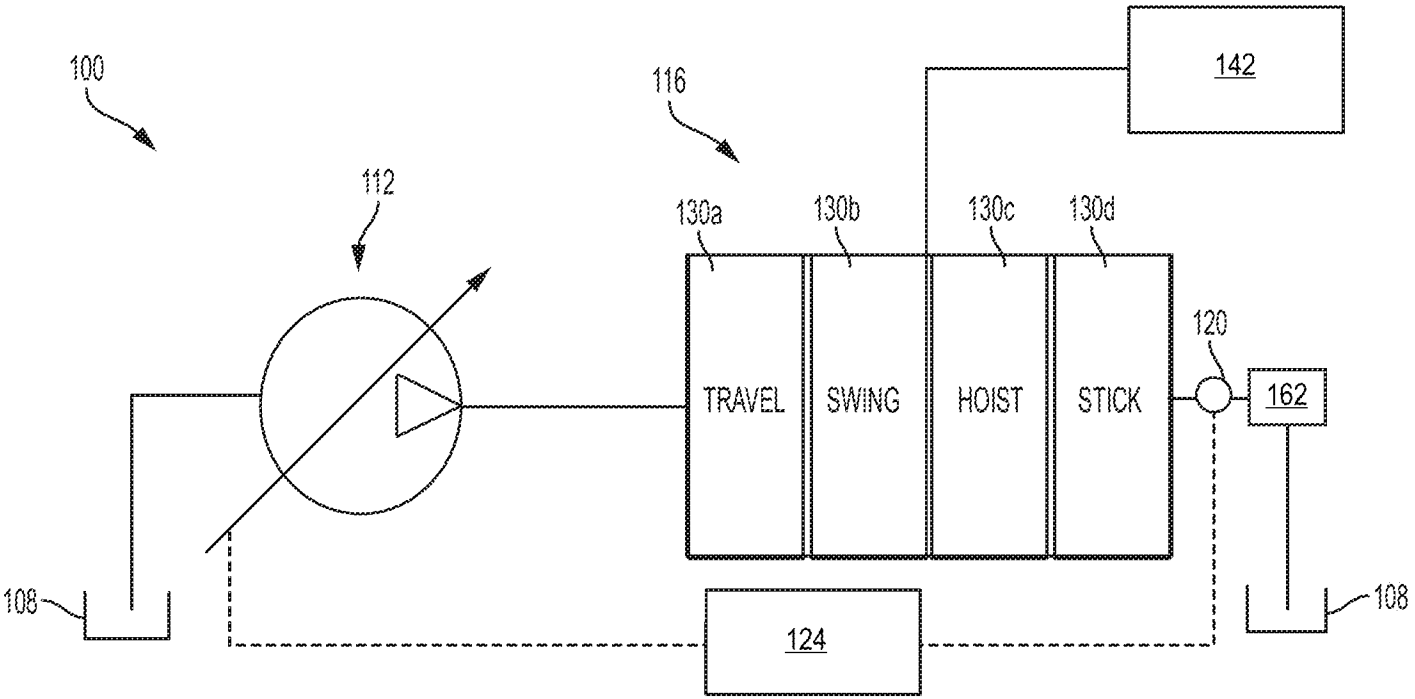
FIG. 2 is schematic view of a hydraulic system of the excavator of FIG. 1.

FIG. 2 illustrates a schematic for a hydraulic system 100 of the excavator 10. The hydraulic system 100 includes a tank or reservoir 108, an electro-hydraulic (EH) variable displacement fluid pump 112, a main directional flow control valve 116 (MCV), a pressure sensor 120, a regulation device 162, and a controller 124. In some embodiments, the pump 112 is a hydrostatic axial piston pump, although other embodiments may include a different type of variable displacement pump. The pump 112 may be driven by the engine and draws fluid from the reservoir 108. The pump 112 is in fluid communication with the main control valve 116 and drives fluid to the main control valve 116.

The main control valve 116 is a hydro-mechanical valve assembly and may include multiple valves 130*a*, 130*b*, 130*c*, 130*d* arranged sequentially and in fluid communication with each other as well as with a respective actuator. Each of the valves 130 has an open-center configuration, such that a portion of the fluid passes through the valve 130 to the reservoir 108, and the control valve 116 as a whole is an open center valve such that, in a neutral condition of valve 116, fluid passes through each of valves 130*a-d* to the reservoir 108. If one of the valves 130 is actuated, however, a portion of fluid is diverted to the respective actuator while another portion of fluid passes through to the subsequent valve(s) 130 and eventually to the reservoir 108. In the illustrated embodiment, the individual valves 130 are independently actuated by movement of a joystick 142.

For example, in the illustrated embodiment, actuation of the valve 130*a* directs pressurized fluid to one or more motors for driving the tracks 18 (FIG. 1), and actuation of the valve 130*b* directs pressurized fluid to one or more motors for swinging or pivoting the frame 14 about the axis 20. In addition, actuation of the valve 130*c* directs pressurized fluid to extend and retract the hydraulic cylinder 46*a* to pivot the hoist portion 38 of the boom 30 (FIG. 1). Finally, actuation of the valve 130*d* directs pressurized fluid to extend and retract the hydraulic cylinder 46*b* to pivot the stick portion 42 (FIG. 1) relative to the hoist portion 38. In other embodiments, the main control valve 116 may include additional valves associated with other actuators on the excavator 10. Although the schematic of FIG. 2 illustrates only one pump 112, control valve 116, pressure sensor 120, and controller 124, it is understood that the hydraulic system 100 may include multiple pumps, control valves, sensors, and controllers.

Figure 3:
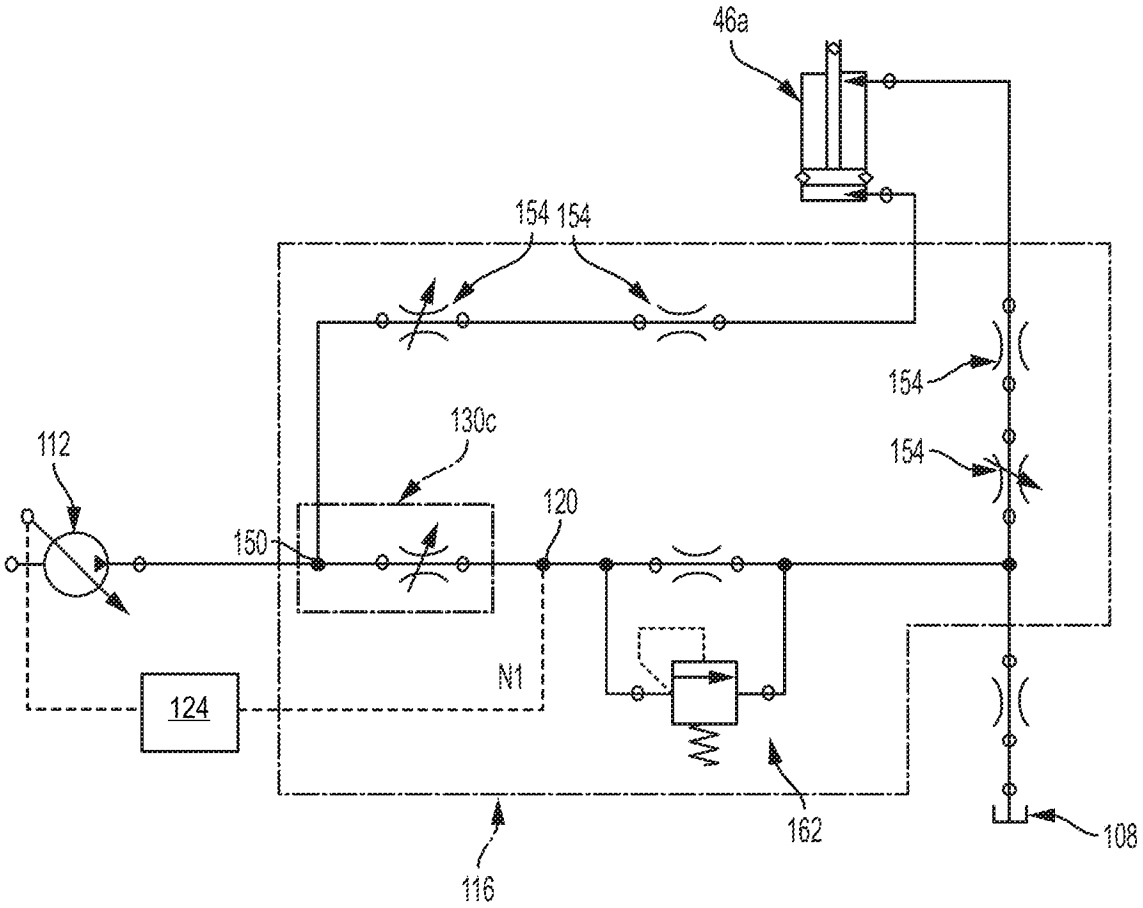
FIG. 3 is a schematic view of a portion of the hydraulic system of FIG. 3 in a first configuration.

FIG. 3 illustrates a detailed schematic of the circuit for the valve 130*c* when it is actuated. For simplicity, only one of the valves 130 is illustrated; it is understood that a similar circuit also may be present for each of the other valves 130. In some embodiments, the valve 130*c* is a directional flow control valve and includes a movable valve member (e.g., a spool—not shown). During operation of the control valve 116, when the valve member of valve 130*c* is shifted, fluid is diverted through a port 150 to the cylinder 46*a*. In the illustrated embodiment, the fluid extends the cylinder 46*a*. It is understood that the flow may be reversed to retract the cylinder 46*a*. The fluid passages may include restrictions 154 (e.g., due to plumbing or internal losses).

Although a portion of the fluid is diverted to actuate the cylinder 46*a*, another portion may pass through the open-center flow passage of valve 130*c*. Some of the portion in the open-center flow passage may be diverted by a subsequent valve 130*d* (not shown) to another actuator, or all of the fluid in the open-center flow passage may pass through and be exhausted to the reservoir 108 from the main control valve 116. The fluid exhausted to the reservoir 108 through the open-center flow passage exhibits an open-center pressure or exhaust pressure.

The pressure-regulating device 162 determines a nominal pressure at which fluid is exhausted from the control valve 116 to the reservoir 108. In the illustrated embodiment, the pressure-regulating device 162 includes a constant orifice and relief valve. The relief valve may open to increase fluid flow to the reservoir 108 if the exhaust pressure exceeds the nominal pressure. The pressure sensor 120 may compare the nominal pressure and the sensed exhaust pressure and generate a signal representing the difference. The difference accounts for a net flow or resultant flow of all functions commanded upstream of the sensor 120, and therefore the pressure difference accounts for the flow requests of multiple functions. In some conditions, all of the fluid received from the pump 112 may be diverted to one of more of the actuators, such that no fluid is exhausted directly from the control valve 116 to the reservoir 108. In such a condition, the sensed exhaust pressure is zero (i.e., the pressure difference is equal in value to the nominal pressure).

The sensor 120 generates a signal corresponding to the open-center or exhaust pressure, and the signal is sent to and received/interpreted by the controller 124. In some embodiments, the controller 124 includes an electronic processor (for example, one or more microprocessors, application specific integrated circuits ("ASICs"), or other electronic devices), a computer-readable, non-transitory memory, and an input/output interface. It should be understood that the controller 124 may include additional components. The memory is configured to store instructions executable by the electronic processor to issue commands (e.g., through the input/output interface). For example, the controller 124 may issue commands to control the displacement of the pump 112. The controller 124 may also receive information (e.g., signals generated by the sensor 120) that the controller 124 may use to determine when and what type of commands to issue. For example, in some embodiments, the controller 124 controls the displacement rate of the pump 112 based on signals measured, received, or calculated by the sensor 120. In some embodiments, the controller 124 can receive inputs or commands from a user. It should be understood that the input/output interface can communicate with components external to the controller 124 (for example, other sensors, valves, pumps, motors, actuators, and the like) over a wired or wireless connection, including local area networks and controller area networks.

Figure 4:
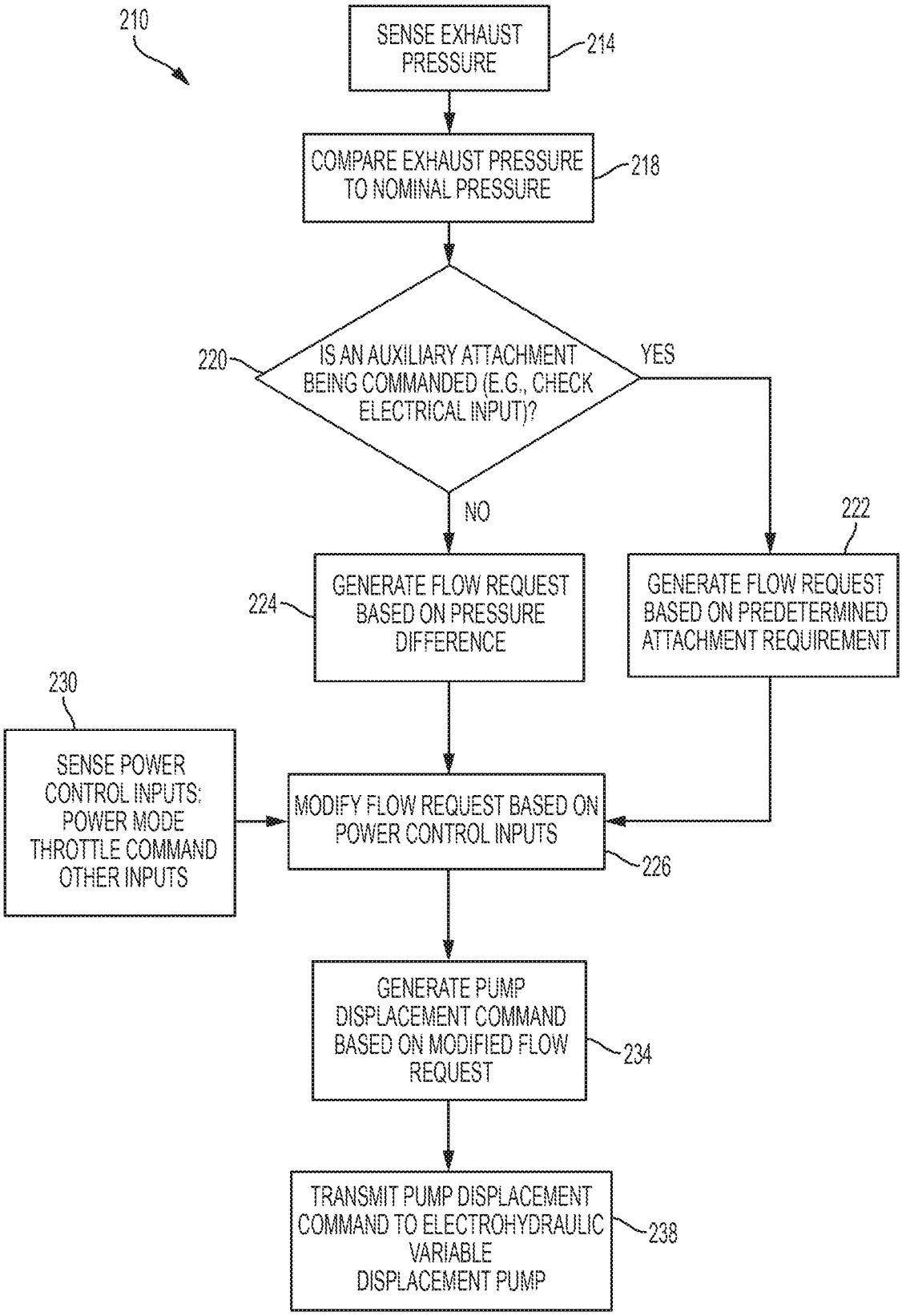
FIG. 4 is a block diagram of a control method for the hydraulic system of FIG. 3.

FIG. 4 illustrates the method 210 for controlling the operation of the variable displacement pump 112. The pressure sensor 120 first senses the open-center or exhaust pressure (step 214), and the exhaust pressure is compared to a nominal pressure value (step 218). Then, the controller 124 determines whether an auxiliary attachment is being controlled (step 220), e.g., via an electrical signal from the joystick 142. If so, a flow request is generated based on a predetermined flow requirement associated with the attachment (step 222), independent of the sensed pressure difference.

If an auxiliary attachment is not being controlled and the difference between the exhaust pressure and the nominal pressure is greater than a predetermined threshold amount, the controller 124 generates an initial flow request based on the pressure difference (step 224). For example, if the sensed exhaust pressure was lower than the nominal pressure, the controller 124 determines the necessary increase in flow from the variable displacement pump 112.

In addition to receiving the exhaust pressure signal, the controller 124 also receives one or more power control input signals (step 230). These power control input signals may be received from, e.g., other controllers on the machine 10 and may be generated based on a variety of signals from the prime mover and based on operator preferences. For example, the power control input signal may include a power mode that is indicative of a maximum power output of the engine (e.g., a heavy mode for large operational requirements, a standard mode for moderate operational requirements, or an economy mode for conserving fuel consumption). The power control input signal may also include a throttle command, which represents a maximum throttle position for the engine driving the variable displacement pump 112. The power control input signal may include other types of power control inputs.

In the illustrated embodiment, the power control input signal provides a restriction for the operation of the variable displacement pump 112. Before adjusting the pump's displacement, the controller 124 compares the generated flow request to the power control inputs. If the flow request would require the pump 112 to exceed one or more of the power control inputs, the flow request is modified to a value that is less than or equal to the power control input(s) (step 226). In other embodiments, the controller 124 may increase the flow request rather than restricting it. When the modified flow request satisfies the limits of the power control inputs, the controller 124 generates a flow command or pump displacement command based on the modified flow request to adjust the operation of the pump 112 to provide a desired displacement (step 234). The displacement command is transmitted to the pump 112 (step 238) to modify the operation of the pump 112.

By providing an electrohydraulic variable displacement pump 112 in electrical communication with an electrical controller 124 and sensor 120, the hydraulic system 100 eliminates the need for valves or fluid couplings to the pump 112. In addition, the hydraulic system 100 may use a hydro-mechanical control valve 116. As a result, the hydraulic system 100 is simpler and more cost-effective. The sensed exhaust pressure is the resultant of any function commanded upstream of the sensor 120, and therefore the pressure signal will represent/account for the flow requests of multiple functions. In addition, the power control method accounts for engine dynamics, fluid power dynamics, and power availability and may provide a cap or limit on the flow request.

Although certain aspects have been described in detail with reference to certain preferred embodiments, variations and modifications exist within the scope and spirit of one or more independent aspects as described. Various features and advantages are set forth in the following claims.

What is claimed is:

1. A fluid power system comprising:

an electro-hydraulic variable displacement fluid pump configured to receive fluid from a fluid reservoir and drive the fluid at a first displacement value;

a directional control valve including an inlet port and at least one outlet port, the inlet port configured to receive the fluid from the pump, the directional control valve further including a valve member movable between a neutral position and at least one actuated position, the directional control valve configured to divert at least some fluid to an actuator while the valve member is in the at least one actuated position, the directional control valve further configured to exhaust fluid at an exhaust pressure through one of the at least one outlet ports to the fluid reservoir while the valve member is in the neutral position;

a sensor for measuring a difference between the exhaust pressure and a nominal pressure, the sensor configured to generate a pressure signal based on the difference between the exhaust pressure and the nominal pressure; and a controller configured to receive the pressure signal from the sensor, generate a flow command to modify the operation of the pump to drive fluid at a second displacement value at least partially based on the pressure signal, selectively operate in one of at least two modes, the flow command being at least partially based on the pressure signal in one of the at least two modes, receive a power control signal for modifying the flow command, and detect an auxiliary attachment and generate a flow command based on a predetermined flow requirement associated with the auxiliary attachment.

2. The fluid power system of claim 1, wherein the directional control valve includes a pressure-regulating device configured to establish the nominal pressure, the pressure-regulating device including a relief valve positioned to fluidly communicate with the inlet port and with the fluid reservoir.

3. The fluid power system of claim 1, further comprising a joystick for receiving a user input and actuate the directional control valve, wherein the directional control valve is hydromechanical.

4. The fluid power system of claim 1, wherein the power control signal is indicative of at least one of a maximum speed of a prime mover driving the pump or a power limit mode of the prime mover.

5. A fluid power system comprising:

an electro-hydraulic variable displacement fluid pump configured to receive fluid from a fluid reservoir and drive the fluid at a first displacement value;

a directional control valve including an inlet port and at least one outlet port, the inlet port configured to receive the fluid from the pump, the directional control valve further including a valve member movable between a neutral position and at least one actuated position, the directional control valve configured to divert at least some fluid to an actuator while the valve member is in the at least one actuated position, the directional control valve further configured to exhaust fluid at an exhaust pressure through one of the at least one outlet ports to the fluid reservoir while the valve member is in the neutral position;

a sensor for measuring a difference between the exhaust pressure and a nominal pressure, the sensor configured to generate a pressure signal based on the difference between the exhaust pressure and the nominal pressure; and a controller configured to receive the pressure signal from the sensor, the controller further configured to generate a flow command to modify the operation of the pump to drive fluid at a second displacement value, the controller selectively operable in one of at least two modes, the flow command being at least partially based on the pressure signal in one of the at least two modes, wherein the controller is configured to receive a power control signal for modifying the flow command and wherein, in another of the at least two modes, the controller is configured to detect an auxiliary attachment and the controller is configured to generate a flow command based on a predetermined flow requirement associated with the auxiliary attachment.

6. The fluid power system of claim 5, wherein the power control signal is indicative of at least one of a power limit mode of a prime mover driving the pump or a maximum speed of the prime mover.

7. A work machine comprising:

a prime mover;

a chassis including a traction drive system and a boom; and a fluid power system including, a fluid reservoir, an electro-hydraulic variable displacement fluid pump driven by the prime mover and configured to receive fluid from the fluid reservoir, the pump operable to drive the fluid at a first displacement value, a directional control valve including an inlet port and at least one outlet port, the inlet port configured to receive the fluid from the pump, the directional control valve further including a valve member movable between a first position and a second position, the directional control valve configured to divert at least some fluid to an actuator while the valve member is in the second position, the directional control valve configured to exhaust fluid at an exhaust pressure through one of the at least one outlet ports to the fluid reservoir while the valve member is in the first position, a sensor for measuring a difference between the exhaust pressure and a nominal pressure, the sensor configured to generate a pressure signal based on the difference between the exhaust pressure and the nominal pressure, and a controller configured to receive the pressure signal from the sensor, generate a flow command to modify the operation of the pump to drive fluid at a second displacement value at least partially based on the pressure signal selectively operate in one of at least two modes, the flow command being at least partially based on the pressure signal in one of the at least two modes, receive a power control signal for modifying the flow command, and detect an auxiliary attachment and generate a flow command based on a predetermined flow requirement associated with the auxiliary attachment.

8. The work machine of claim 7, wherein the directional control valve includes a pressure-regulating device configured to establish the nominal pressure, the pressure-regulating device including a relief valve in fluid communication with the inlet port and with the fluid reservoir.

9. The work machine of claim 7, further comprising a joystick for receiving a user input, wherein the directional control valve is actuated hydromechanically.

10. The work machine of claim 7, wherein the power control signal is indicative of a maximum speed of the prime mover.

11. The work machine of claim 7, wherein the power control signal is indicative of a power capacity of the prime mover.

12. A method for operating a fluid power system of a work machine, the method comprising:

operating a variable displacement electro-hydraulic fluid pump to supply a fluid at a first displacement value to a directional control valve;

electrically sensing a pressure difference between a nominal pressure and an exhaust pressure of fluid exhausted from the directional control valve to a fluid reservoir;

generating a flow command based on the sensed pressure difference or a predetermined flow requirement associated with an auxiliary attachment supported on the work machine;

in response to the flow command, modifying the operation of the pump to drive the fluid at a second displacement value different from the first displacement value;

selectively operating in one of at least two modes, the flow command being at least partially based on the pressure signal in one of the at least two modes;

receiving a power control signal for modifying the flow command, and detecting an auxiliary attachment and generating a flow command based on a predetermined flow requirement associated with the auxiliary attachment.

13. The method of claim 12, wherein electrically sensing a difference includes detecting a pressure difference equal in value to the nominal pressure when no fluid is exhausted from the directional control valve to the fluid reservoir.

14. The method of claim 12, further comprising:

generating a power control signal indicative of a maximum value of the flow command;

comparing the flow command to the power control signal; and if implementation of the flow command would cause a system condition to exceed a predetermined threshold, modifying the flow command such that the system condition that does not exceed the threshold.

15. The method of claim 14, wherein generating the power control signal includes sensing a maximum speed of a prime mover driving the pump.

16. The method of claim 14, wherein generating the power control input includes sensing a power capability of a prime mover driving the pump.

* * * * *